US005344234A

United States Patent [19]

Caveza

[11] Patent Number: 5,344,234

[45] Date of Patent: Sep. 6, 1994

[54] TOY BEVERAGE MIXER AND DISPENSER

[75] Inventor: Martin J. Caveza, Redondo Beach, Calif.

[73] Assignee: Mattel, Inc., El Segundo, Calif.

[21] Appl. No.: 10,738

[22] Filed: Jan. 29, 1993

[51] Int. Cl.[5] ..... B01F 15/02; A63H 33/30

[52] U.S. Cl. ..... 366/192; 366/252; 366/207; 446/479

[58] Field of Search ..... 446/479, 475; 366/194, 366/192, 252, 247, 197, 253, 254, 207; 222/156

[56] References Cited

U.S. PATENT DOCUMENTS

| | | | |
|---|---|---|---|
| D. 101,703 | 10/1936 | Kruck . | |
| D. 285,892 | 9/1986 | Doyel . | |
| 1,288,195 | 12/1918 | Reinhardt | 366/192 |
| 1,844,691 | 2/1932 | Schneider et al. | 366/252 |
| 2,030,908 | 2/1936 | Barnett et al. . | |
| 3,100,588 | 8/1963 | Pearson, Jr. | 446/475 X |
| 3,171,636 | 3/1965 | Barlow et al. | 446/479 X |
| 3,774,338 | 11/1973 | Waak | 446/481 |
| 4,497,580 | 2/1985 | Doyel | 366/190 |
| 5,114,375 | 5/1992 | Wellhausen et al. | 446/475 X |

*Primary Examiner*—Mickey Yu
*Attorney, Agent, or Firm*—Roy A. Ekstrand

[57] ABSTRACT

A toy beverage mixer and dispenser includes a horizontal support and vertical support combined to support a cylindrical mixing container. A crank housing is pivotally secured to the vertical support and includes a hand crank operated drive mechanism which is coupled to a rotating mixing blade extending downwardly into the mixing container. A dispensing valve is supported at the lower portion of the mixing container and controls the dispensing of mixed beverage into a drinking cup supported upon the horizontal support beneath the dispensing valve. The mixing blade is removable from the crank mechanism for cleaning and the entire mixing container and dispensing valve is similarly removable for cleaning operation.

7 Claims, 2 Drawing Sheets

TOY BEVERAGE MIXER AND DISPENSER

FILED OF THE INVENTION

This invention relates generally to beverage mixers and dispenser and particular to those suitable for use by younger children.

BACKGROUND OF THE INVENTION

Soda fountain treats such as sundaes, sodas and milkshakes have for many years proven to be extremely popular with a broad range of consumers. These types of treats are perhaps particularly enjoyed by younger children. One of the most favorite soda fountain type treats is that generally referred to as a milkshake or malted milk both of which are often referred to generically as "milkshakes" or simply "shakes". The creation of such milkshakes is relatively simple and involves combining milk, ice cream, flavoring and sometimes malted milk powder as well as other optional ingredients such as fruit or the like in a mixer or blender to produce a smooth creamy beverage. Other types of similar beverages are produced in mixers or blenders such as "fruit smoothies" or the like.

Children's toys often mirror or mimic adult activities. In the case of soda fountains and the like, this trend has existed for some time. However, the concerns for safety and ease of operation raised when children's toys versions of such soda fountain apparatus are contemplated substantially limit the operation of the mixers or blenders.

As would be expected, the popularity of such blended or mixed types of beverages has prompted practitioners in the art to create a wide variety of mixing and blending apparatus. For example, U.S. Pat. Des. No. 285,892 issued to Doyel sets forth a MIXER/POURER FOR DRINKS in which a cylindrical beverage container supports a pouring spout, a handle and an upper housing mechanism. The upper housing mechanism supports a plurality of downwardly extending mixer elements together with a drive mechanism for rotating the mixer elements within the beverage container.

U.S. Pat. No. 2,030,908 issued to Barnett, et al. sets forth a DISPENSING APPARATUS having a cylindrical mixing chamber pivotally secured to a generally planar base support. A latch mechanism secures the mixing chamber to the base and a dispensing valve is operable to dispense the mixing chamber contents into the base. A covering lid supports a crank mechanism and downwardly extending set of mixer blades operative within the mixing chamber.

U.S. Pat. No. 3,774,338 issued to Waak sets forth PERCOLATOR/BLENDER TOYS in which a blender vessel is securable to and supportable by a simulated blender base mechanism. The base includes a rotating drive assembly which engages a rotating mechanism within the beverage vessel to simulate percolating activity or the like within the vessel.

U.S. Pat. No. 4,497,580 issued to Doyel sets forth a TWO-MOTOR BATTERY-OPERATED MIXER-POURER having a mixing vessel and a combination blender and pump apparatus in which a first motor operates to drive a beverage pump for forcing the beverage from the mixing chamber to the dispensing spout and a second motor operates to rotate a set of mixing blades.

U.S. Pat. No. 5,114,375 issued to Wellhausen, et al. sets forth a TOY APPARATUS having a fluid container supporting an upper lid assembly. A crank handle is rotatably secured to the upper assembly and is coupled through a gear drive mechanism to a plurality of downwardly extending blender elements. As the handle is cranked, the gear drive assembly rotates the downwardly extending blender elements within the mixing chamber.

U.S. Pat. Des. No. 101,703 issued to Cruck sets forth a COMBINED ELECTRIC FOOD MIXER AND FRUIT JUICER having a base member defining a container support surface and an upwardly extending support arm. A motor driven juice mechanism is supported by the upwardly extending arm and is operative to extract juice from a citrus fruit or the like which is collected in a container received upon the planar support surface.

While the foregoing described prior art devices have enjoyed some level of success and effectiveness, there remains nonetheless a continuing need in the art for evermore improved and realistic children's toy which provide the benefit of child operable mixing and blending devices.

SUMMARY OF THE INVENTION

Accordingly, it is a general object of the present invention to provide an improved toy beverage mixer and dispenser. It is a more particular object of the present invention to provide an improved toy beverage mixer and dispenser which is safe and easy to operate and which may readily be used by younger children.

In accordance with the present invention, there is provided a beverage mixer and dispenser comprises: a base having a vertically extending support; a mixing container coupled to the vertically extending support and defining an interior cavity; a crank housing pivotally coupled to the vertically extending support and positionable in a first position overlying the mixing container and a second position pivoted away from the mixing container; a crank rotatably supported upon the crank housing; a mixing blade; and mixing blade drive means supporting the mixing blade and coupled to the crank for rotating the mixing blade in response to crank rotation.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
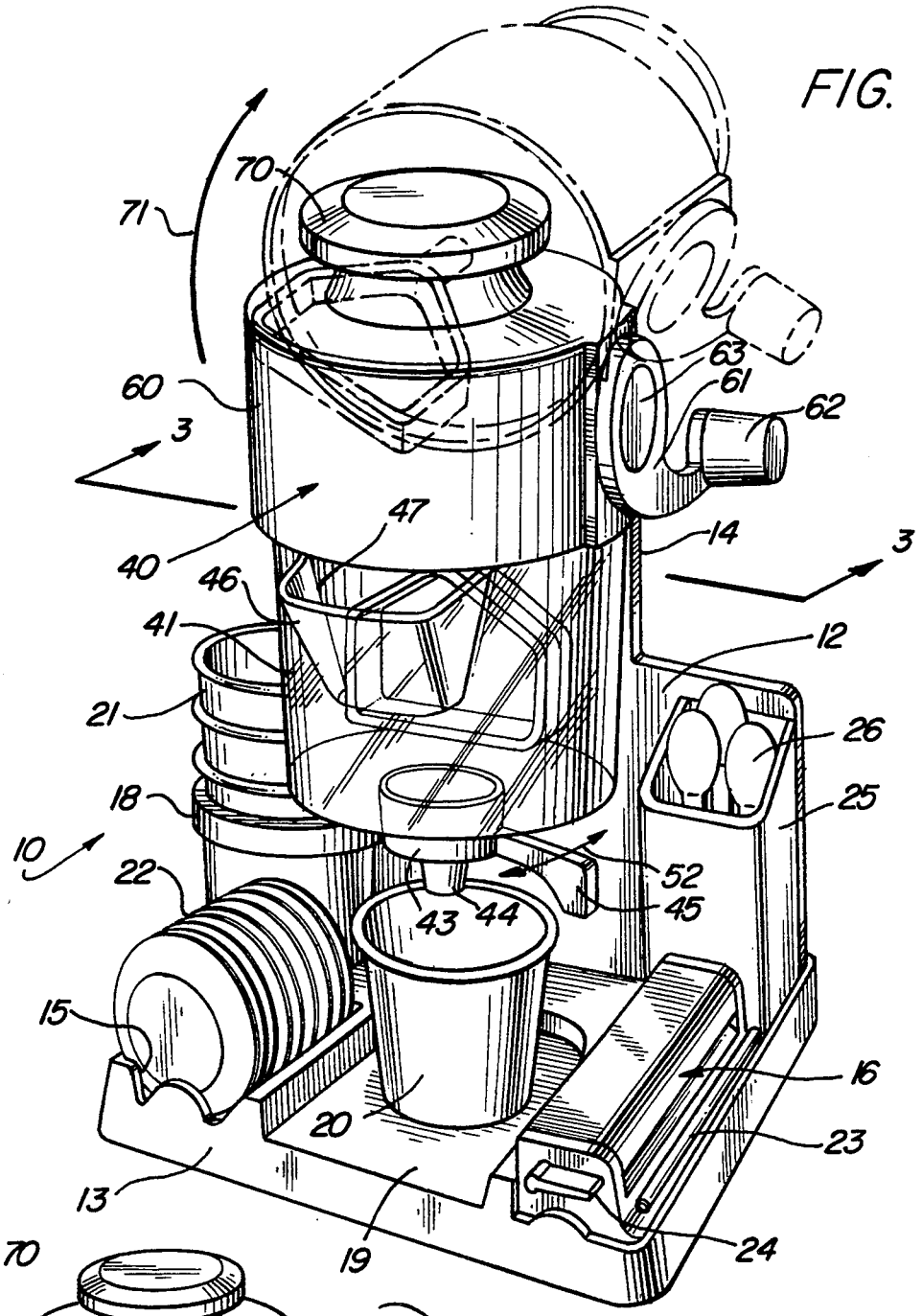
FIG. 1 sets forth a front perspective view of a toy beverage mixer and dispenser constructed in accordance with the present invention.

FIG. 1 sets forth a perspective view of a toy beverage mixer and dispenser constructed in accordance with the present invention and generally referenced by numeral 10. Mixer 10 includes a base 11 having a generally planar vertical support 12 and a horizontal support 13. Vertical support 12 includes a horizontally extending circular cup ring 18 and a generally rectangular upwardly open spoon receptacle 25. Vertical support 12 further includes an extension 14 which as is set forth below in FIG. 2 supports a mixing and dispensing unit 40. A plurality of cups 21 are received and supported within cup ring 18 while a plurality of spoons 26 are received and supported within spoon receptacle 25. Horizontal support 13 includes a generally planar cup resting surface 19, a dish tray 15 and a straw dispenser 16. Dish tray 15 receives and supports a plurality of small dishes 22. A cup 20 is shown received upon and supported by cup resting surface 19. Straw dispenser 16 is constructed in accordance with conventional fabrication techniques and includes a supply of straws stored therein (not shown) which are dispensed in singular fashion by movement of lever 24. A straw 23 is shown resting in the dispensed position for straw dispenser 16.

Figure 2:
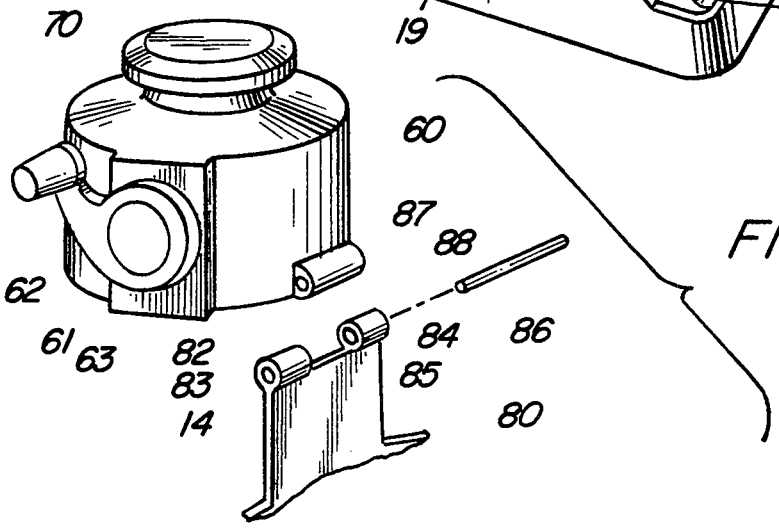
FIG. 2 sets forth a perspective assembly view of a portion of the present invention toy beverage mixer and dispenser.

A mixing and beverage dispensing unit generally referenced by numeral 40 is pivotally secured to extension 14 of vertical support 12 by a hinge coupling 80 (seen in FIG. 2). Mixing and dispensing unit 40 includes a mixing container 41 defining an interior cavity 42 (seen in FIG. 3). Mixing container 41 further defines a forwardly extending spout 46 defining an upwardly facing opening 47 therein. As is better seen in FIG. 4, mixing container 41 and extension 14 include a removable attachment mechanism by which mixing container 14 is independently supported by extension 14 of vertical support 12 in a removable attachment.

Figure 3:
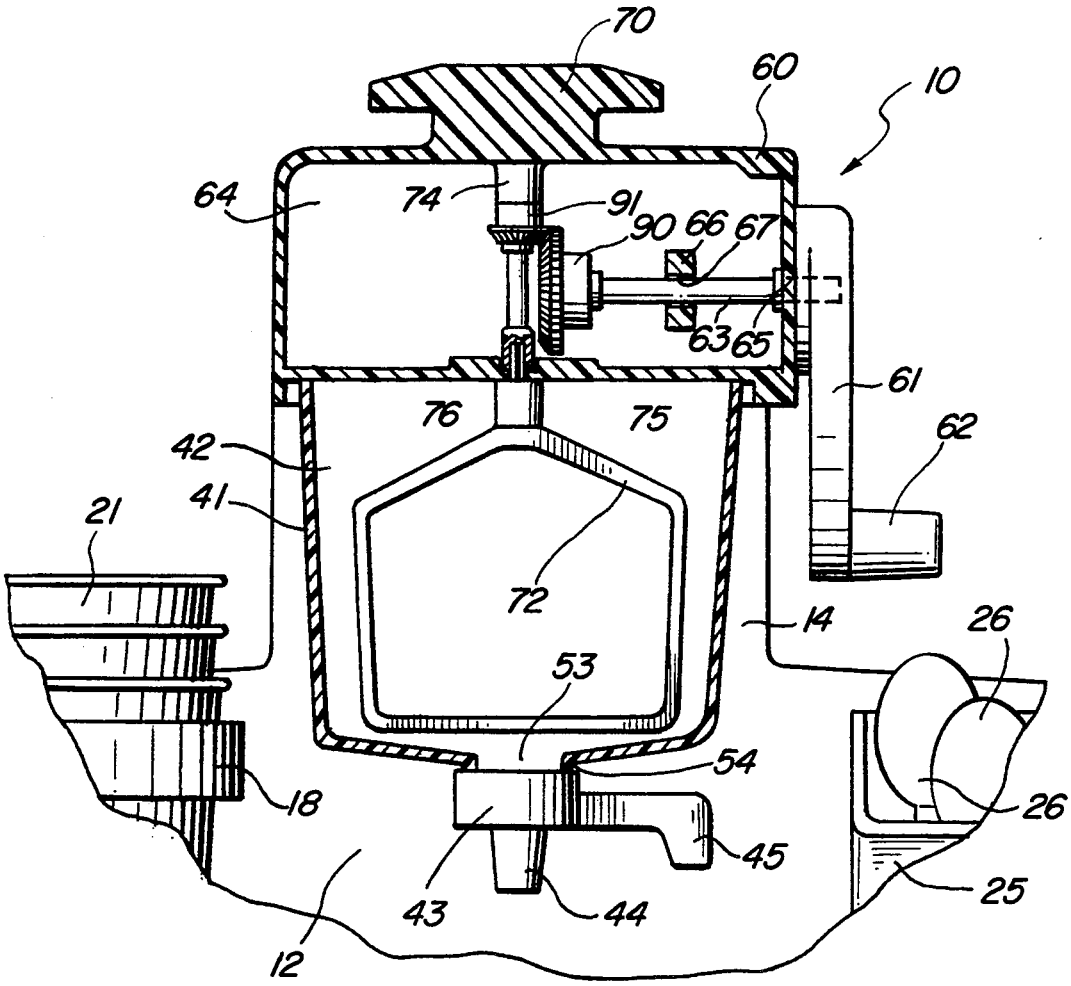
FIG. 3 sets forth a partial section view of the present invention toy beverage mixer and dispenser taken along section lines 3—3 in FIG. 1.

Mixing and dispensing unit 40 further includes a generally cylindrical housing 60 defining an interior cavity 64 (seen in FIG. 3). Crank housing 60 further defines an upwardly extending knob 70 and a crank drive shaft 63. Crank drive shaft 63 supports an elongated crank 61 having a knob 62 at the extended end thereof. By means set forth below in greater detail, a mixing blade 72 is rotatably supported within crank housing 60 and extends downwardly into mixing container 41. To facilitate the cleaning of mixer 10, mixing unit 40 is pivotally secured to extension 14 of vertical support 12 by a hinge coupling 80 (seen in FIG. 2). Thus, in accordance with the present invention, crank housing 60 may be pivoted in the direction indicated by arrow 71 to the open position shown in dashed line representation in FIG. 1. The pivoting of crank housing 60 to the raised position also raises mixing blade 72 and exposes mixing container 41. Thereafter, mixing container 41 together with dispensing valve 43 may be removed from vertical support 12 for easy cleaning. In addition, mixing blade 72 is removable for cleaning activities by means set forth below.

In operation, crank housing 60 is positioned in the closed position shown and a cup 20 is placed upon surface 19 beneath nozzle 44. Thereafter, the ingredients to be mixed within mixing container 41 are introduced into interior cavity 42 through opening 47 of spout 46. Alternatively, crank housing 60 may be raised by pivoting housing 60 in the direction indicated by arrow 71 to better expose interior cavity 42 of mixing container 41 and the to-be-mixed ingredients introduced accordingly. In this method once the ingredients have been introduced into interior cavity 42, crank housing 60 is pivoted downwardly to the closed position shown.

In either event, the mixing operation is carried forward by rotation of crank 61 as the child user grasps knob 62 thereof and preferably also holds knob 70 to maintain the position of mixer 10. Thereafter, the vigorous turning of crank 61 rotates mixing blade 72 within interior cavity 42 causing the ingredients therein to be mixed. Once the desired consistency is obtained in the blending operation, the user then moves valve lever 45 to open dispensing valve 43 and discharge a portion of the now blended contents within interior cavity 42 downwardly through nozzle 44 into cup 20. Once the desired quantity is dispensed, the user then closes dispensing valve 43 by moving valve lever 45 to the closed position afterwhich cup 20 may be withdrawn and the contents consumed. While the structure of dispensing valve 43 and valve lever 45 may utilize virtually any convenient valve mechanism, it has been found particularly advantageous a rotationally operable dispensing valve mechanism of the type well known in the prior art for dispensing valve 43. As a result, the movement of valve level 45 back and forth in the directions indicated by arrows 52 provides a simple opening and closing operation for the child user in dispensing the blended contents within mixing container 41.

While a wide variety of ingredients may be utilized within mixing container 41 to provide the above-described blended operation of mixer and blender 10, a particularly advantageous beverage is obtained by using a powdered pudding mix of the variety known as "instant pudding" so named because of the absence of any need for heating or cooking as the basic element of the "milkshake" to be blended. Thereafter, a quantity of milk substantially greater than the quantity normally utilized in the pudding recipe is introduced into interior cavity 42 and crank handle 61 is rotated as described above. With vigorous rotation, the combination of diluted pudding mix and milk assumes a frothy milkshake-like consistency which is extremely enjoyable to the child user both as to appearance and taste.

Once the child user has completed the milkshake making play pattern described above, mixer and blender 10 may be cleaned easily by pivoting crank housing 60 upwardly in the direction indicated by arrow 71 to the dashed line open position which facilitates removal of mixing blade 72 and mixing container 41 together with dispensing valve 43. Thereafter, mixing blade 72 and the combination of mixing container 41 and dispensing valve 43 may be conveniently washed in the sink or other washing facility in an easy and convenient process. Once cleaning is complete, the reassembly process is carried forward in the reverse order by simply returning mixing blade 72 to crank housing 60 and reinstalling mixing container 41 upon extension 14 of vertical support 12.

FIG. 2 sets forth a perspective assembly view of crank housing 60 and hinge coupling 80 showing the attachment thereof to extension 14 of vertical support 12. As described above, crank housing 60 supports a crank shank 63, a knob 70 and a rotatable crank arm 61. The latter terminates in an outwardly extending knob 62. Crank housing 60 further includes an elongated generally cylindrical hinge member 87 having a bore 88 extending therethrough. Correspondingly, extension 14 of vertical support 12 defines a pair of spaced apart hinge members 82 and 84 having a spacing therebetween slightly greater than the width of hinge member 87. Hinge members 82 and 84 define cylindrical bores 83 and 85 respectively. With hinge member 87 positioned between hinge members 82 and 84, an elongated cylindrical hinge pin 86 is placed within bores 83, 85 and 88 to complete the attachment of hinge coupling 80.

FIG. 3 sets forth a partial section view of mixer and blender 10 taken along section lines 3—3 in FIG. 1. As described above, base 11 includes vertical support 12 having a cup ring 18, a spoon receptacle 25 and an extension 14. A mixing container 41 defines an interior cavity 42 and is secured to extension 14 in the manner shown in FIG. 4. Mixing container 41 further defines a downwardly extending neck portion 54 having an aperture 53 therethrough. A dispensing valve 43 is secured to neck 54 in accordance with conventional fabrication techniques and includes a nozzle 44 and a valve lever 45. As is also described above, a crank housing 60 defines an interior cavity 64 and an upwardly extending knob 70. Crank housing 60 is pivotally secured to extension 14 in the manner shown in FIG. 2. Crank housing 60 further defines an aperture 65 and a shaft support 66 having an aperture 67 formed therein. A crank drive shaft 63 extends through aperture 65 of crank housing 60 and aperture 67 of support 66. A crank 61 having a knob 62 is secured to the extending portion of crank drive shaft 63 in accordance with conventional fabrication techniques. A bevel gear 90 is secured to the interior end of crank drive shaft 63 in accordance with conventional fabrication techniques.

Crank housing 60 further defines a bearing 74 extending downwardly from the center portion of crank housing 60 and an aperture 75 formed in the lower surface of crank housing 60 in alignment with bearing 74. A bearing 73 surrounds aperture 75. A coupling shaft 77 extends downwardly into bearing 73 and defines an interior socket 78. Coupling shaft 77 extends upwardly and is received within bearing 74. A bevel gear 91 is received upon and secured to coupling shaft 77 in a position of engagement with bevel gear 90. Mixing blade 72 defines an upwardly extending lock shaft 76 which passes through aperture 75 and is received within socket 78 of coupling shaft 77. The fabrication of lock shaft 76 and socket 78 may be configured in accordance with design choice. However, it has been found advantageous to utilize a cruciform cross-sectioned shaft 76 and a corresponding cruciformed shaped cross-section for socket 78. The essential feature is that lock shaft 76 is removably insertable into socket 78 to couple mixing blade 72 to coupling shaft 77.

In operation, crank 61 is rotated in the manner described above causing a corresponding rotation of crank drive shaft 63 which in turn rotates bevel gear 90. The rotation of bevel gear 90 produces a corresponding rotation of bevel gear 91 due to the engagement therebetween which in turn rotates coupling shaft 77 and mixing blade 72. In its preferred form, the gear ratio between bevel gear 90 and bevel gear 91 provides a speed multiplication such that gear 91 is substantially smaller than gear 90. This provides a higher speed rotation of mixing blade 72 to improve the blending operation.

Figure 4:
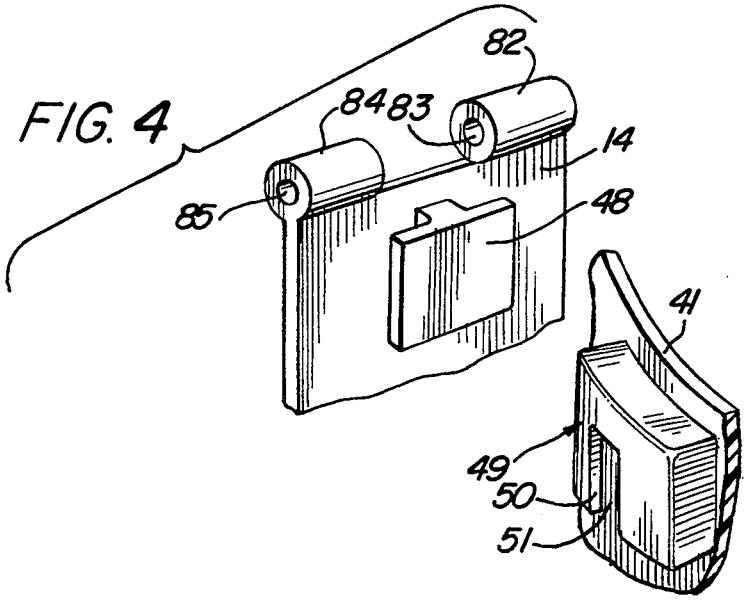
FIG. 4 sets forth a partial perspective view of the mixing container attachment of the present invention toy beverage mixer and dispenser.

FIG. 4 sets forth a perspective view of the supporting attachment between mixing container 41 and extension 14 of vertical support 12. As described above, support 12 defines a pair of spaced apart hinge members 82 and 84 having cylindrical bores 83 and 85 respectively formed therein. Extension 14 further defines a forwardly extending generally T-shaped support tab 48. Correspondingly, mixing container 41 defines a rearwardly extending tab receptor 49 having a slot 50 and a tab slot 51 formed therein. The attachment of mixing container 41 to extension 14 is achieved by aligning slot 50 and tab slot 51 with the base and transverse portions of T-shaped support tab 48 and thereafter lowering receptor 49 onto support tab 48. The removal of mixing container 41 is achieved by the reverse operation in which mixing container 41 is simply raised with respect to extension 14.

What has been shown is a simple, easy to use toy beverage and mixer dispenser which provides substantial enjoyment and entertainment for young children. The system facilitates the operation of the mixing or shake making apparatus while protecting the child user from potential injury. The mixing head is tiltable to an open position permitting the mixing blade and mixing container together with the dispensing valve to be removed for easy cleaning operation. The provision of a dispensing valve at the bottom portion of the mixing container provides an added entertainment and amusement value for the child user in dispensing the mixed beverage into a drinking cup.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A beverage mixer and dispenser comprising:

a base having a vertically extending support;

a mixing container coupled to said vertically extending support and defining an interior cavity, a bottom surface having an aperture, an upwardly facing opening, an edge encircling said opening and a material input spout;

a crank housing pivotally coupled to said vertically extending support and positionable in a first position overlying said mixing container and a second position pivoted away from said mixing container, said crank housing defining a lower edge generally conforming to said upper edge of said mixing container exclusive of said spout;

a crank rotatably supported upon said crank housing;

a dispensing valve coupled to said bottom surface for opening or closing said aperture.;

a mixing blade; and mixing blade drive means supporting said mixing blade and coupled to said crank for rotating said mixing blade in response to crank rotation, said crank housing and said mixing container cooperating when said crank housing is in said first position to generally enclose said mixing blade while said input spout facilitates introduction of material into said interior cavity.

2. A beverage mixer and dispenser as set forth in claim 1 wherein said crank housing and said vertically extending support define cooperating hinge coupling members to provide said pivotal coupling.

3. A beverage mixer and dispenser as set forth in claim 2 wherein said mixing container is removably coupled to said vertically extending support.

4. A beverage mixer and dispenser as set forth in claim 3 wherein said mixing container defines an extending spout having an upwardly facing opening, said spout extending beyond said crank housing when said crank housing is in said first position.

5. A beverage mixer and dispenser as set forth in claim 4 wherein said vertically extending support includes a horizontally extending cup receiving ring.

6. A beverage mixer and dispenser as set forth in claim 4 wherein said base defines a horizontal cup resting surface beneath said dispensing valve.

7. A beverage mixer and dispenser as set forth in claim 4 wherein said vertically extending support defines an upwardly opening spoon receptacle.

* * * * *